United States Patent [19]

Henning

[11] 4,042,019

[45] Aug. 16, 1977

[54] WIRELINE ACTUATED TUBING CUTTER

[76] Inventor: Jack A. Henning, P.O. Box 158, Refugio, Tex. 78377

[21] Appl. No.: 666,904

[22] Filed: Mar. 15, 1976

[51] Int. Cl.[2] ..... E21B 29/00

[52] U.S. Cl. ..... 166/55; 166/63; 166/209

[58] Field of Search ..... 166/55, 55.1, 55.2, 166/63, 209–211; 102/21.2; 89/1 B

[56] References Cited

U.S. PATENT DOCUMENTS

| | | | |
|---|---|---|---|
| 2,067,408 | 1/1937 | Morris | 166/63 |
| 2,761,384 | 9/1956 | Sweetman | 166/55 |
| 2,776,715 | 1/1957 | Fuson et al. | 166/63 |
| 2,947,250 | 8/1960 | Mohaupt | 166/55 |
| 2,984,307 | 5/1961 | Barnes | 166/55 |
| 3,006,416 | 10/1961 | Roach et al. | 166/209 |
| 3,057,295 | 10/1962 | Christopher | 166/55 |
| 3,282,354 | 11/1966 | Hakala et al. | 166/55 |

*Primary Examiner*—James A. Leppink
*Attorney, Agent, or Firm*—Pravel, Wilson & Gambrell

[57] ABSTRACT

An apparatus adapted to be run into a well on a wireline for explosively cutting tubing having an explosive cutting member mounted with a body member connected to the wireline, a settable hanging member for securing the body member within the bore of the tubing prior to detonation of the explosive member, and a wireline actuated firing mechanism to explosively activate the explosive cutting means for severing the tubing in the well.

6 Claims, 8 Drawing Figures

W
A
12
12a
14a
B
14
14b
14d
14c
28b
16a
28a
28
S
16b
32
28e
30
16c
16d
28c
28f
16e
F
28d
16g
16f
48a
18h
48
18e
18f
34
34
18i
16
18a
R
18g
16i
18b
18
18
48
18b
48b
50e
18d
18j
18c
22
22a
20a
22b
50
B
20
R
20b
20g
10a
T
10b
50b
20c
20d
2
2
H
36g
36
36a
36b
36c
20k
20e
10
36d
20h
20j
20j
20i
36e
38c
38
38d
36f
38a
38b
20e
A
50a
20g
20f
50c
26a
26
R
B
26c
26b
50d
24a
52
26d
F
24f
T
44
10
46a
24
24b
46
E
46b
40
42
24e
24d
24c
J
12
14

WIRELINE ACTUATED TUBING CUTTER

BACKGROUND OF THE INVENTION

The field of this invention is tubing cutters, particularly of the type used for explosively severing tubing.

U.S. Pat. Nos. 3,199,287; 3,199,594; 3,331,321; 3,411,597; 3,710,717; and, 3,800,705 disclose wireline actuated tools used to perforate tubing for forming orifices therein as well as wireline actuated tools for providing explosive jars and downhole seismic sounding surveys. Further, electrically actuated explosive pipe cutters are disclosed in the prior art. However, no attempt has been made to securely located a tubing cutter within the well bore prior to severance of the tubing. An unrestrained cutter assembly may not operate as effectively as desired should the cutter be allowed to vacillate freely within the well bore during the cutting operation. So far as is known, no attempt has been made heretofore to have a wireline actuated tool wherein the wireline operation acts to not only set the tool within the tubing but also actuate an explosive mechanism for severing the tubing.

SUMMARY OF THE INVENTION

The present invention relates to a new and improved apparatus adapted to be run into a well on a wireline for explosively cutting tubing having explosive cutting means mounted with a wireline-connected body member, the body member having settable hanging means therewith for securing the body member with the bore of the tubing prior to detonation of the explosive cutting means, and wireline-actuated means for firing the explosive cutting means for severing the tubing in the well.

DESCRIPTION OF THE PREFERRED EMBODIMENT

Figure 1A:
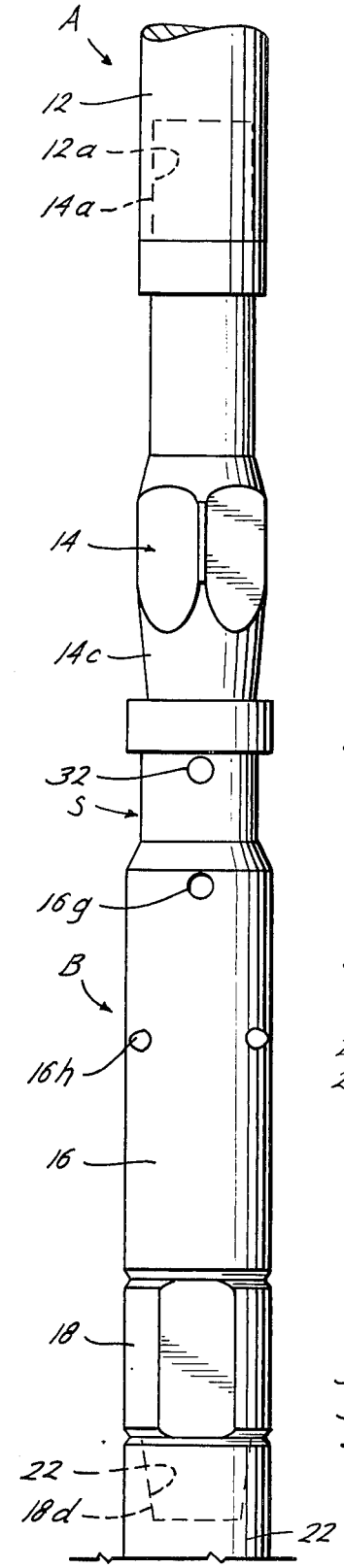
FIG. 1A is an elevational view showing the upper portion of the apparatus of the present invention.
Figure 1B:
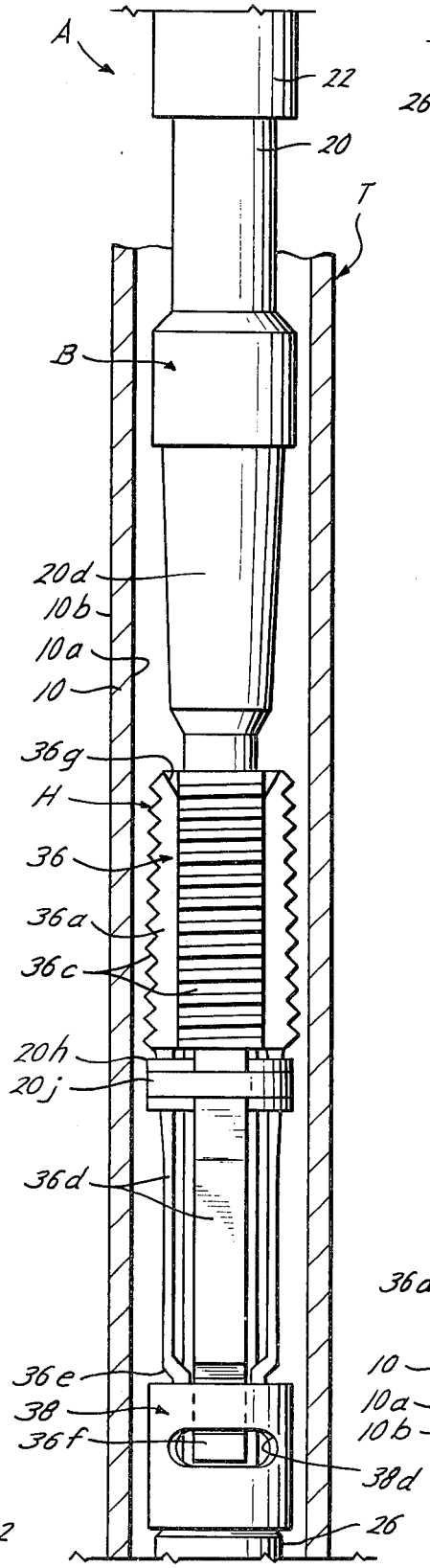
FIG. 1B is an elevational view of the mid-portion of the apparatus of the present invention showing the settable hanging means of the present invention.
Figure 1C:
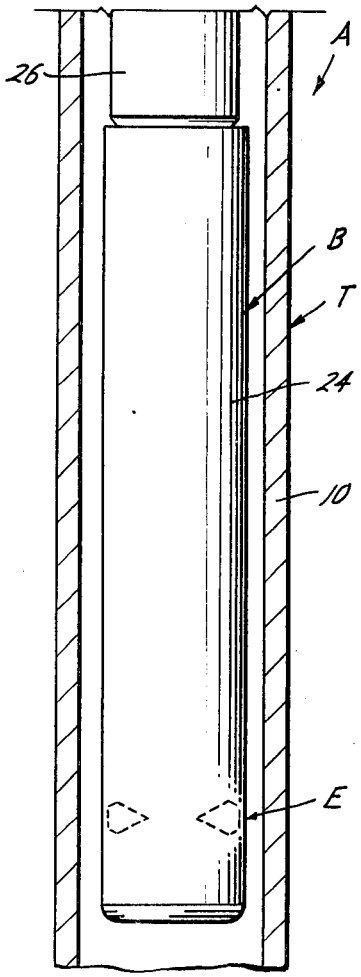
FIG. 1C is an elevational view of the lower portion of the apparatus of the present invention.
Figure 2:
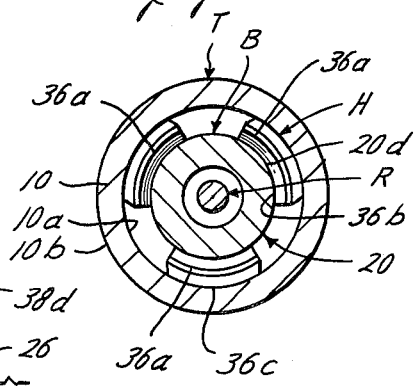
FIG. 2 is a plan view of the apparatus of the present invention, taken along the lines 2—2 of FIG. 3B, showing the settable hanging means.

In the drawings, the letter A designates the apparatus of the present invention. The apparatus A is adapted to be run into a well on a wireline W for explosively cutting the tubing T of the well. The apparatus A includes an explosive cutting means E mounted with a body member B. The body member B includes settable hanging means H for securing the body member B with the tubing T prior to detonation of the explosive cutting means E. Firing means F is mounted with the body member B and is actuated by the wireline W to explosively activate the explosive cutting means E for severing the tubing T in the well. Unless otherwise noted, the components of this invention are made of steel capable of taking heavy stresses and strains without failure, although other suitable high strength materials may be used if desired.

As shown in FIGS. 1B, 1C, 3B, 3C, the apparatus A of the present invention is adapted to be run into a well for explosively cutting the tubing T thereof. The tubing T may be of any type and/or designation such as casing, and the like. The tubing T includes tubing 10 having an inner bore **10*a* and an outer annular surface 10*b***.

The apparatus A is adapted to be run into the tubing T by a wireline W appropriately connected to surface-mounted wireline equipment (not shown). The wireline W (FIG. 3A) is adapted to be received in a rope socket 12 having means (not shown) for securing such a wireline W therewith. The rope socket 12 includes threads shown schematically at **12*a* for affixing the rope socket 12** with the body member B.

The body member B includes an upper connector sub 14 connected with a tubular body portion 16, mounted with body adapter 18. The body adapter 18 is connected with tubular member 20 by tubular connector 22. Further, the body member B includes an explosive housing member 24 mounted with the tubular member 20 by body connector 26.

The upper connector sub 14 includes thread **14*a* compatible with threads 12*a* of rope socket 12 for threadedly engaging the same, for providing a threaded connection between rope socket 12 and upper connector sub 14. The upper connector sub 14 further includes a hammer body 14*b* having an inverted, conical, tapered surface 14*c*** formed adjacent the lower end thereof.

Figures 3A, 3B, 3C, 4:
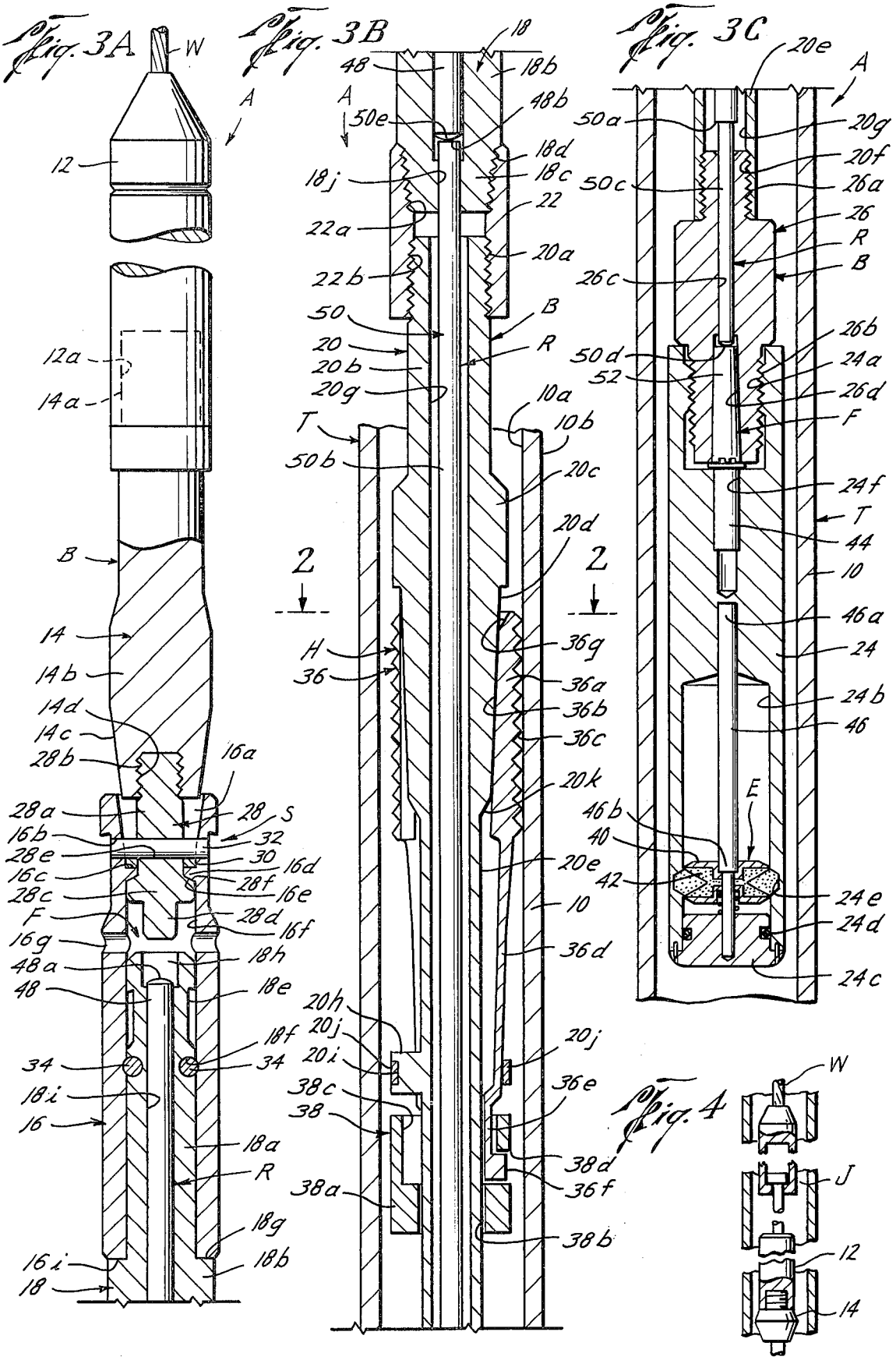
FIG. 3A is an elevational sectional view of the upper portion of the apparatus of the present invention showing the shear pin assembly of the present invention.
FIG. 3B is an elevational sectional view of the mid-portion of the apparatus of the present invention, showing the settable hanging means of the present invention.
FIG. 3C is an elevational sectional view of the lower portion of the apparatus of the present invention showing the explosive cutting means of the present invention; and, FIG. 4 is an elevational view of a wireline actuated jar used with the apparatus of the present invention.

The upper connector sub 14 and tubular body portion 16 are connected together by shear pin assembly S (FIG. 3A). The shear pin assembly S includes a firing head assembly 28 having a central portion **28*a* having threads 28*b* adjacent the upper end thereof and adapted to be received in threads 14*d* formed in upper connector sub 14, a firing head 28*c* and a contact portion 28*d*. An opening 28*e* is formed in the central portion 28*a* of the firing head assembly 28**.

The tubular body portion 16 is adapted to receive the firing head assembly 28 (FIG. 3A) adjacent the upper end thereof. The tubular body portion 16 is formed having an inverted, conical, tapered surface **16*a* conforming substantially to that of surface 14*c* on upper connector sub 14, and adapted to receive the same. An opening 16*b* is formed adjacent surface 16*a* and substantially perpendicular to longitudinal axis of the apparatus A of the present invention, and being substantially the same diameter and aligned with opening 28*e* formed in firing head assembly 28. A washer 30 is adapted to be placed in recess 16*c* formed in the tubular body portion 16. An annular lip 16*d* is formed adjacent to recess 16*c* with the lip 16*d* having an inclined surface 16*e* formed therewith. Further, the tubular body portion is formed having vent holes 16*g* (FIGS. 1A, 3A) formed in communication with an inner bore 16** f.

In its dormant position, the shear pin assembly S is positioned as shown in FIG. 3A. In this position, surface **28*f* of the firing head 28*c* engages surface 16*e* of the tubular body portion 16 with the firing head 28*c* being disposed within the bore 16*f*** of the tubular body portion 16. Washer 30 prevents fluid migration therebetween bore 16*f* and the areas adjacent surface 16*a* with the washer 30 having an inner bore corresponding substantially to that of the central portion 28*a* of the firing head assembly 28. A shear pin 32 is adapted to be positioned within aligned openings 28*e* and 16*b* to prevent any unwanted longitudinal movement of the upper connector sub 14 with respect to the tubular body portion 16 as described more fully hereinbelow.

The body adapter 18 (FIG. 3A) includes a neck portion 18*a*, a central portion 18*b* and a threaded portion 18*c* having threads 18*d*. The neck portion 18*a* includes a fishing tool recess 18*e* and openings 18*f* adapted to receive shear pins 34. Shear pins 34 are adapted to be inserted within openings 16*h* (FIG. 1A) formed in tubular body portion 16 and aligned with openings 18*f* (FIG. 3A) formed in neck portion 18*a* of the body adapter 18 for connecting the body adapter 18 with the tubular body portion 16. As shown in FIG. 3A, the neck portion 18*a* is adapted to be disposed within the bore 16*f* of the tubular body portion 16 with the annular lip 18*g* adjacent the juncture of neck portion 18*a* and central portion 18*b* abutting the lower end 16*i* of the tubular body portion 16. A cylindrical recess 18*h* is formed adjacent the upper end of the neck portion 18*a* and is adapted to receive contact portion 28*d* of the firing head assembly 28 as discussed more fully hereinbelow. Further, bore 18*i* is formed centrally of the body adapter 18 with a reduced bore 18*j* formed adjacent threaded portion 18*c*.

The tubular connector 22 connects with body adapter 18 by means of threads 22*a* which engage threads 18*d* (FIG. 3B). Threads 22*b* of tubular connector 22 engage threads 20*a* of body member 20 formed adjacent the upper end thereof. The tubular member 20 includes a neck portion 20*b* formed adjacent the threads 20*a*, a stepped portion 20*c*, an inverted, conically tapered surface 20*d*, inclined surface 20*k*, and an elongate lower neck portion 20*e* having threads 20*f* (FIG. 3C) formed adjacent the lower end of the neck portion 20*e*. The tubular member 20 further includes a bore 20*g* formed along substantially the entire length of the tubular member 20.

The settable hanging means H is movably mounted with the body member B adjacent inverted, conically tapered surface 20*d* and elongate lower neck portion 20*e*. The settable hanging means H secures the body member B with the bore 10*a* of the tubing 10 prior to the detonation of the explosive cutting means E. The settable hanging means H includes slip means 36 and drag shoe assembly 38. Slip means 36 includes slips 36*a* of preferably three in number, each slip 36*a* having an inclined surface 36*b* adapted to co-act with surface 20*d* of tubular member 20. Each slip 36*a* has an inclined surface 36*g* adjacent the upper end thereof and serrations 36*c* adapted to engage the bore 10*a* of the tubular member 10. Slips 36*a* further include a neck 36*d* which connects the slips 36*a* with its mounting portion 36*e*. The mounting portion 36*e* movably mounts the slips 36*a* with drag shoe assembly 38 to allow freedom of longitudinal movement upwardly and/or downwardly along elongate neck portion 20*e* with respect to the tubular member 20 of the body member B.

Drag shoe assembly 38 (FIG. 3B) includes a cylindrical sleeve 38*a* having a bore 38*b* substantially approximating the diameter of the elongate neck portion 20*e* of the tubular member 20 and a counterbore 38*c* adjacent the upper end thereof. A plurality of elongate openings 38*d* (FIGS. 1B, 3B) are formed in the cylindrical sleeve 38*a*, with each of such elongate openings 38*d* adapted to receive the mounting portion tab 36*f* of the mounting portion 36*e* of each slip 36*a*. The neck 36*d* of each slip 36*a* is adapted to be disposed between annular tabs 20*h* formed with the tubular member 20, with each of such tabs 20*h* having a suitable recess 20*i* for mounting retaining ring 20*j* therein, for movably securing the slips 36*a* with the tubular member 20. As such, the slips 36*a* may move vertically along surface 20*d* of the tubular member 20 as the drag shoe assembly 38 correspondingly moves along the elongate neck portion 20*e*, with the slips 36*a* being appropriately located and constrained by the sleeve 38*a* and tabs 20*h* and ring 20*j*. As slips 36*a* move upwardly with surface 36*b* in engagement with surface 20*d*, the diameter about the slips 36*a* increases radially as the slips move upwardly due to the inclined nature of surfaces 20*d*, 36*a*. The slips 36*a* are movable vertically until the drag shoe assembly 38 contacts tabs 20*h* of tubular member 20. Conversely, as the slips move downwardly from the step portion 20*c*, the diameter about the slips is reduced as the drag shoe assembly 38 correspondingly moves downwardly along the elongate neck portion 20*e*, until the slips 36*a* reach their fully retracted position wherein surfaces 36*g* and 20*k* abut and surface 36*b* contacts neck portion 20*e*.

Body connector 26 (FIG. 3C) has threads 26*a* adjacent the upper end thereof which are adapted to engage threads 20*f* of tubular member 20. Further, the body connector 26 engages explosive housing member 24 by threads 26*b* adjacent the lower end thereof making a threaded connection therewith threads 24*a* of the explosive housing member 24. Bore 26*c* and inclined tapered bore 26*d* are formed centrally of the body connector 26.

The explosive housing member 24 (FIG. 3C) is formed having an air chamber 24*b* formed adjacent the lower end thereof with an aluminum cap 24*c* preferably sealing the lower end of the air chamber 24*b* from the bore 10*b* of the tubing 10 by seal rings 24*d*. Preferably, the explosive cutting means E is located within the air chamber 24*b* adjacent a recess 24*e* formed in the walls of the air chamber 24*b*. Preferably, the explosive cutting means E includes a housing 40 preferably formed of aluminum and capable of housing a cone-shaped explosive charge 42. A recess 24*f* is formed adjacent the upper end of the explosive housing member 24 to provide a housing for the detonator assembly 44. An explosive 46 is mounted adjacent the detonator assembly 44 at the upper end 46*a* thereof and with the housing 40 adjacent the lower end 46*b* thereof.

Firing means F is mounted with the body member B and is actuated by wireline W to explosively detonate the explosive cutting means E for severing the tubing T in the well. The firing means F includes the shear pin assembly S (FIG. 3A) described hereinabove and rod means R (FIGS. 3A, 3B, 3C). The rod means R is movably mounted within the body member B between the shear pin assembly S and the explosive cutting means E. The rod means R includes firing pin extension 48 adapted to be disposed within bore 18*i* of the body adapter 18. Rod 50 is adapted to be disposed in reduced bore 18*j* of the body adapter 18, through bore 20*g* of the tubular member 20 and therethrough bore 26*c* in body connector 26. It should be noted that shoulder 50*a* separates the upper portion 50*b* of the rod 50 from the lower portion 50*c* of the rod 50 wherein the lower portion 50*c* has a reduced diameter corresponding substantially to that of reduced bore 26*c* while upper portion 50*b* has a diameter corresponding substantially to that of bore 18*i*. The lower end portion 50*d* of rod 50 is in engagement with firing pin 52 which is adapted to be disposed within tapered bore 26*d* within body connector 26.

In the use or operation of the apparatus A of the present invention, the apparatus A is run into tubing T on a wireline W until the body member B is at the desired location for severing the tubing T to be cut. With the body member B at the proper subsurface elevation, a downward setting force is transmitted by the wireline W to the body member B by an appropriate mechanism, such as a conventional wireline-actuated jar J shown schematically in FIG. 4. The wireline actuated jar J may be of the link type with suitable weights thereabove (not shown). As described below, the wireline actuated jar J may be used to impart a hammering force.

A quick downward acceleration by releasing wireline W or jarring by jar J of the body member B results in the slip means 36 engaging the bore 10*a* of tubing 10 by means of serrations 36*c* for grippingly engaging the same. As the body member B is briefly accelerated downwardly through the tubing T, the slips 36*a* having surfaces 36*b* co-acting with surface 20*d* of tubular member 20 expand outwardly to securely engage the bore 10*a* of the tubing 10 which locates the body member B with respect to the tubing T. Once located, the apparatus A of the present invention is adapted to be activated for severing the tubing T.

To detonate the explosive cutting means E, it is necessary for the wireline W to transmit a downward detonating force, acting in the same direction as the downward setting force, merely of greater magnitude than necessary to locate the body member B within the tubing T. The downward detonating force which may be generated by a wireline actuated jar J must be sufficient to result in the shear pin 32 being sheared such that the upper connector sub 14 moves downwardly with respect to the tubular member 20. As the jar J jars the body member B in a downwardly direction, the body member is further set within the tubing T by settable hanging means H. The settable hanging means H is designed to withstand such forces without failing. Further, it will be appreciated that during this operation, it is desirable that there not be an upward jarring action by jar J, for such action would cause the release of the settable hanging means H.

The shearing action of shear pin 32 results in the surface 14*c* of the upper connector sub 14 being received by surface 16*a* of tubular body portion 16 with a corresponding movement of the firing head assembly 28 downwardly. Downward movement of the firing head assembly 28 results in the contact portion 28*d* being received in cylindrical recess 18*h* of the body adapter 18. The contact portion 28*d* moves downwardly to impact the upper end 48*a* of firing pin extension 48 with the downward force being transmitted through the firing pin extension 48 to lower end 48*b* thereof. The lower end portion 48*b* adjacent to upper end portion 50*e* of rod 50 results in movement of the rod 50 downwardly in response thereto, resulting in lower end portion 50*d* jarring the firing pin 52 downwardly into the detonator assembly 44. The downward motion of the firing pin 52 into detonator assembly 44 energizes an explosive charge within the detonator assembly 44 which is explosively communicated with explosive 46 thereto explosive cutting means E. Thereafter, the explosive cutting means E, being explosively energized, detonates with the shaped charge 42 directing the explosive pressure radially outwardly in the direction of recess 24*e*, exploding through the wall portion of the explosive housing member 24 adjacent recess 24*e* and therethrough the tubing T adjacent thereto. For the most effective cutting action, it is desired that the outside diameter of the explosive housing member 24 closely correspond to the bore 10*a* of the tubing 10 in order to achieve maximum effectiveness for severing the tubing T.

Thereafter, the apparatus A of the present invention may be removed from the tubing T by an upward, unsetting force, transmitted by the wireline W through the jar J to the body member B. This upward, unsetting force is preferably of a jerking nature to unset the slip 36*a* engagement with the bore 10*a* of the tubing 10 by the serrations 36*c*. Should the apparatus A of the present invention be damaged during the explosive operation thereof, and not be unset by the upward, unsetting force, increased unsetting forces in an upward direction results in shear pins 34 shearing with the wireline W being able to retrieve the jar J, the rope socket 12, upper connector sub 14 and tubular body portion 16 since the surface 28*f* of the firing head 28*c* engages tubular body portion surface 16*e* to prevent release therefrom. As such, thereafter, a fishing tool (not shown) may be lowered into the tubing T to engage fishing tool recess 18*e* formed with the body adapter 18 for efficient removal of the remaining parts of the apparatus of the present invention from the tubing T.

It will be appreciated that the shear pin assembly S provides a positive restraint against inadvertant activation and detonation of the explosive cutting means E which is important for the safe operation of the apparatus A of the present invention.

Therefore, the apparatus A of the present invention provides a new and improved apparatus A for the safe, explosive cutting of tubing T, having in combination settable hanging means H and a mechanically actuated firing means F for detonating the explosive cutting means E for severing the tubing T within a well.

The foregoing disclosure and description of the invention are illustrative and explanatory thereof, and various changes in the size, shape and materials as well as in the details of the illustrated construction may be made without departing from the spirit of the invention.

I claim:

1. An apparatus adapted to be run into a well on a wireline for explosively cutting tubing, comprising:

explosive cutting means for explosively cutting tubing in a well;

a body member having an upper end and a lower end, said upper end of said body member being connected to the wireline and said lower end of said body member having said explosive cutting means mounted therewith;

settable hanging means movably mounted with said body member above said explosive cutting means for securing said body member with the bore of the tubing prior to detonation of said explosive cutting means, said settable hanging means being set by a downward setting force and released by an upward setting force; and, firing means for mechanically firing said explosive cutting means, said firing means mounted with said body member and actuated by the wireline transmitting a downward mechanical detonating force to said firing means to explosively activate said explosive cutting means for severing the tubing in the well.

2. The apparatus of claim 1, wherein said firing means includes:

a shear pin assembly mounted with said upper end of said body member allowing movement of said body member with the wireline with said firing means in a dormant position whereupon in response to said downward detonating force transmitted by the wireline, said shear pin assembly shears permitting movement of said firing means to a detonating position for activating said explosive cutting means.

3. The apparatus of claim 2, wherein said firing means further includes:

rod means movably mounted within said body member between said shear pin assembly and said explosive cutting means, said rod means moving from said dormant position to said detonating position in response to said shear pin assembly shear movement.

4. The apparatus of claim 1, wherein:

said upper end of said body member includes means for receiving a fishing tool for removal of said body member after detonation of said explosive cutting means should said body member become lodged with the well.

5. The apparatus of claim 1, wherein said settable hanging means includes:

an inverted conical surface formed on said body member between said upper end and said lower end thereof and above said explosive cutting means; and, slip means movably mounted with said body member for engaging the bore of the tubing in response to said downward setting force, said slip means being wedged in gripping engagement between the bore of the tubing and said inverted conical surface to locate said body member in the well.

6. The apparatus of claim 1, wherein:

said explosive cutting means is a conically-shaped explosive charge for severing the tubing.

* * * * *